US006189606B1

(12) United States Patent
Chevallier

(10) Patent No.: US 6,189,606 B1
(45) Date of Patent: Feb. 20, 2001

(54) FLUID BOX-MANIFOLD ASSEMBLY FOR HEAT EXCHANGER, IN PARTICULAR FOR MOTOR VEHICLE

(75) Inventor: Christophe Chevallier, Le Mans (FR)

(73) Assignee: Valeo Climatisation, La Verriere (FR)

( * ) Notice: Under 35 U.S.C. 154(b), the term of this patent shall be extended for 0 days.

(21) Appl. No.: 09/508,894

(22) PCT Filed: Jul. 16, 1999

(86) PCT No.: PCT/FR99/01754

§ 371 Date: Mar. 17, 2000

§ 102(e) Date: Mar. 17, 2000

(87) PCT Pub. No.: WO00/04331

PCT Pub. Date: Jan. 27, 2000

(30) Foreign Application Priority Data

Jul. 17, 1998 (FR) ..... 98 09154

(51) Int. Cl.[7] ..... F28F 9/02

(52) U.S. Cl. ..... 165/173; 165/76; 165/176; 29/890.052

(58) Field of Search ..... 165/76, 173, 175, 165/176; 29/890.052

(56) References Cited

U.S. PATENT DOCUMENTS 3,612,264 * 10/1971 Trunick ..... 206/57
5,390,733 * 2/1995 Young ..... 165/173

FOREIGN PATENT DOCUMENTS 55-112993 * 9/1980 (JP) ..... 165/173
61-76890 * 4/1986 (JP) ..... 165/176

* cited by examiner

*Primary Examiner*—Allen Flanigan
(74) *Attorney, Agent, or Firm*—Morgan & Finnegan LLP

(57) ABSTRACT

The invention concerns a fluid box-manifold assembly for a heat exchanger comprising at least a single-piece housing produced by swaging a sheet metal and including; a cap comprising a base linked to a peripheral wall defining an open surface, and a cover including a base provided with holes for receiving the tube ends of a tube bundle and linked to a peripheral edge matching in shape the cap peripheral wall, the cap and the cover being linked by a material strip forming a bend line, such that the cap and the cover can be mutually brought together up to an interlocking position to define an internal volume of the fluid box. The invention is applicable to motor vehicle heat exchanger.

11 Claims, 1 Drawing Sheet

FLUID BOX-MANIFOLD ASSEMBLY FOR HEAT EXCHANGER, IN PARTICULAR FOR MOTOR VEHICLE

BACKGROUND OF THE INVENTION

The invention relates to a fluid box/manifold assembly for a heat exchanger, in particular of a motor vehicle.

It applies to the various types of heat exchangers which may be encountered in a vehicle, whether these are the radiator for heating the passenger compartment, or the radiator for cooling the engine, the condenser of the air-conditioning circuit, or even the evaporator of the air-conditioning circuit.

These heat exchangers consist of a bundle of parallel tubes, provided with fins, carrying out the thermal exchange with the external medium. The tubes of the bundle are linked, at least at one of their ends, by an end unit defining the flow direction of the fluid in the various tubes and allowing the fluid to be introduced into the exchanger and to be extracted therefrom. In the majority of cases, the bundle is linked to two end units.

Each of the end units includes a metal manifold plate, or "hole plate", into which the tubes of the bundle open out, these tubes being secured to this plate, for example by brazing, at the point where they open out. This plate, generally referred to as the "manifold", is capped by a cover or "fluid box" so that the manifold and the box define a common volume into which the corresponding ends of the tubes open out, and through which the fluid enters and leaves as appropriate.

The fluid box is provided with connections to ducts for intake and collection of fluid. Its internal volume may be furthermore subdivided into a plurality of separate subvolumes allowing certain groups of tubes in the bundle to be joined together so as to define a predetermined configuration for fluid flow in the exchanger, with optionally several round trips of fluid in the tube bundle. Hence, an end unit therefore comprises at least one manifold and one fluid box which need to be assembled jointly.

Until now, the manifold and the fluid box have been formed by separate elements which then need to be assembled, either by a brazing technique or by a mechanical assembling technique.

BRIEF SUMMARY OF THE INVENTION

The invention relates to a particular technique for manufacturing a fluid box/manifold assembly, which may also be referred to as the end unit, which is essentially applicable in the case of assembling by brazing. In particular, the invention aims to rationalise production by simplifying the assembling, standardising the elements and reducing the number of different parts to be assembled in order to make such an assembly or end unit.

For this purpose, the invention proposes a fluid box/manifold assembly, of the type defined in the introduction, which comprises at least one housing produced in a single piece by stamping a sheet metal and comprising:

- a cap including a base which is linked to a peripheral wall delimiting an open face, and
- a cover including a base which is provided with holes suitable for accommodating ends of tubes and is linked to a peripheral edge having a shape matching that of the peripheral wall of the cap,
- the cap and the cover being linked by a strip of material constituting a fold line, so that the cap and the cover can be mutually brought together into an interlocking position in which the peripheral wall and the peripheral edge are interlocked in order to delimit an internal volume of the fluid box.

The fluid box/manifold assembly, or end unit, intended to be linked to one end of the tube bundle hence comprises at least one single-piece housing forming both the fluid box and the manifold and hence delimiting an internal volume of the fluid box.

In order to produce such an assembly, it is sufficient to stamp a sheet metal in order to form a cap and a cover which are joined by a strip of material, which can subsequently be folded so as to allow them to be mutually brought together. The cover is hence tilted into the interlocking position.

Optional, additional or alternative characteristics of the invention are listed below:

The peripheral wall of the cap and the peripheral edge of the cover are of quadrilateral overall shape, the strip of material linking two equivalent sides of the cap and of the cover.

The two equivalent sides of the cap and of the cover are longitudinal sides.

The two equivalent sides of the cap and of the cover are transverse sides.

In the interlocking position, the peripheral edge of the cover is surrounded by the peripheral wall of the cap;—in the interlocking position, the peripheral edge of the cover and the peripheral wall of the cap are secured by joint brazing.

The assembly is formed from an aluminium-based sheet metal.

The cap is provided with at least one orifice for intake or discharge of fluid.

The cap is completely closed, with the exception of its open face, so as to allow a reversal of the fluid direction.

In another aspect, the invention relates to a heat exchanger comprising a bundle of parallel tubes which are joined, at least at one of their ends, by a manifold capped by a fluid box closing the manifold in a leaktight fashion and defining with it at least one internal volume imposing predetermined flow directions of the fluid in the tubes of the bundle, the manifold and the fluid box comprising a manifold/fluid box assembly as defined previously.

The invention also relates to a method for producing an assembly as defined above, in which a single-piece housing including:

- a cap including a base which is linked to a peripheral wall delimiting an open face, and
- a cover including a base which is provided with holes suitable for accommodating ends of tubes and is linked to a peripheral edge having a shape matching that of the peripheral wall of the cap,
- is produced by stamping a sheet metal,
- one side of the said peripheral wall and one side of the said peripheral edge being arranged substantially in the same plane and being linked to each other by a strip of material,
- and the cover is tilted relative to the cap about a fold line defined by the said strip of material so as to interlock the peripheral edge and the peripheral wall in one another.

BRIEF DESCRIPTION OF THE DRAWINGS

In the description which follows, given solely by way of example, reference is made to the appended drawings, in which.

DETAILED DESCRIPTION OF THE INVENTION

Figure 1:
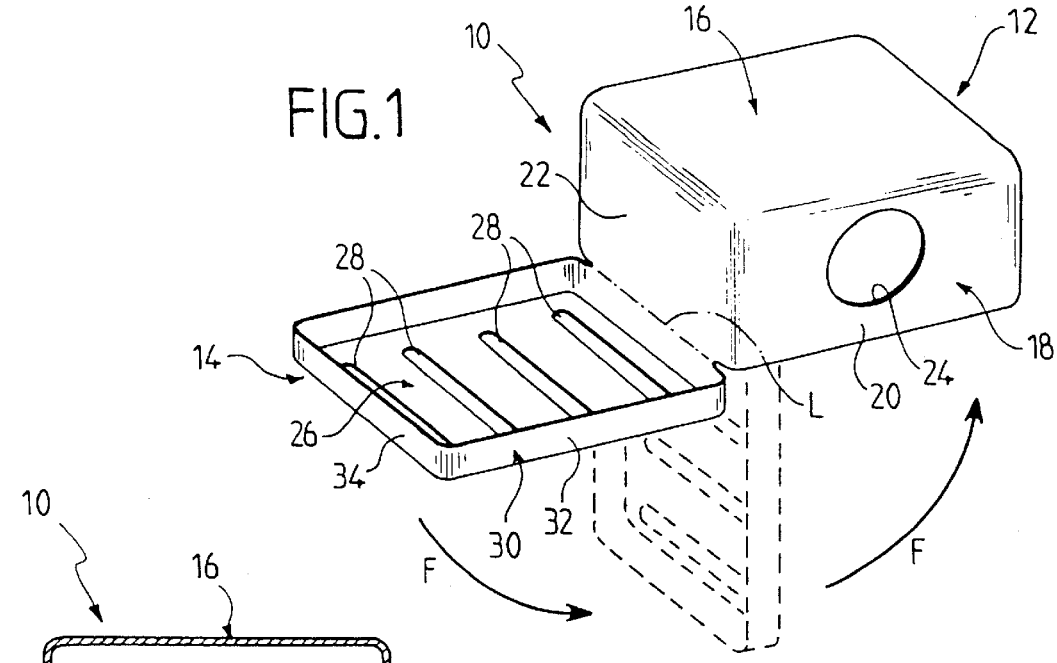
FIG. 1 is a perspective view of a housing suitable for forming part of a fluid box/manifold assembly according to the invention, the housing being represented in a position where the cap and the cover are mutually apart.

FIG. 1 represents a housing 10 suitable for forming part of a fluid box/manifold assembly according to the invention. This housing is produced in a single piece by pressing from a sheet metal, advantageously an aluminium-based sheet, which is covered, on at least one of its faces, with a brazing alloy plating.

The single-piece housing 10 comprises a cap 12 and a cover 14 forming a flap. The cap 12 includes a flat base 16 of rectangular shape linked to a peripheral wall 18 delimiting an open face of rectangular overall shape. The peripheral wall 18 comprises two longitudinal sides 20 (only one of which can be seen in FIG. 1) and two transverse sides 22 (only one of which can be seen in FIG. 1).

The sides 20 and 22 are linked at a right angle to each other by rounded edges and are linked also at a right angle with the base 16 by rounded edges. An orifice 24 used for intake or discharge of a fluid is formed in one of the longitudinal sides 20.

The cover 14 includes a flat base 26 of rectangular overall shape provided with elongated holes 28, of which there are four in the example (FIGS. 1 and 2), suitable for subsequently accommodating ends of the tubes of a heat-exchanger bundle.

The base 26 is linked to a peripheral edge 30 which has a shape matching that of the peripheral wall 18 of the cap so that it can be fitted tightly by interlocking inside this peripheral wall.

The peripheral edge 30 comprises two longitudinal sides 32 and two transverse sides 34. The cap 12 and the cover 14 are linked to each other by a strip of material 36 suitable for forming a fold line L. This strip of material links one of the transverse sides 22 of the cap and one of the transverse sides 34 of the cover. The cap as shown in FIG. 1 is in its configuration after stamping. In this position, the respective bases 16 and 26 of the cap and of the cover are in substantially parallel planes, the cap and the cover turning their concavities respectively in opposite directions.

It is then sufficient to tilt the cover 14 in the direction of the housing 16 by a rotational movement about the fold line 36, as shown by the arrows F [lacuna]. During this rotation, the cover 14 successively occupies a multiplicity of intermediate positions, of which one of them is represented by broken lines in FIG. 1.

Figure 2:
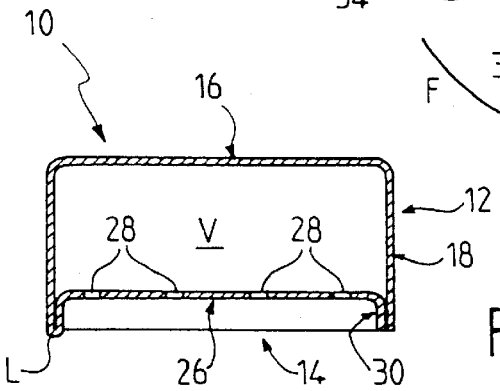
FIG. 2 is a sectional view of the housing in FIG. 1, the cap and the cover being mutually interlocked.

At the end of the rotational movement, the cover 14 is completely interlocked inside the cap 16, as FIG. 2 shows. Because the peripheral wall 18 and the peripheral edge 30 have matching shapes, they cooperate tightly and can subsequently be secured permanently by brazing.

In the interlocking position, the cap and the cover delimit an internal volume V (FIG. 2) of the fluid box.

Figure 3:
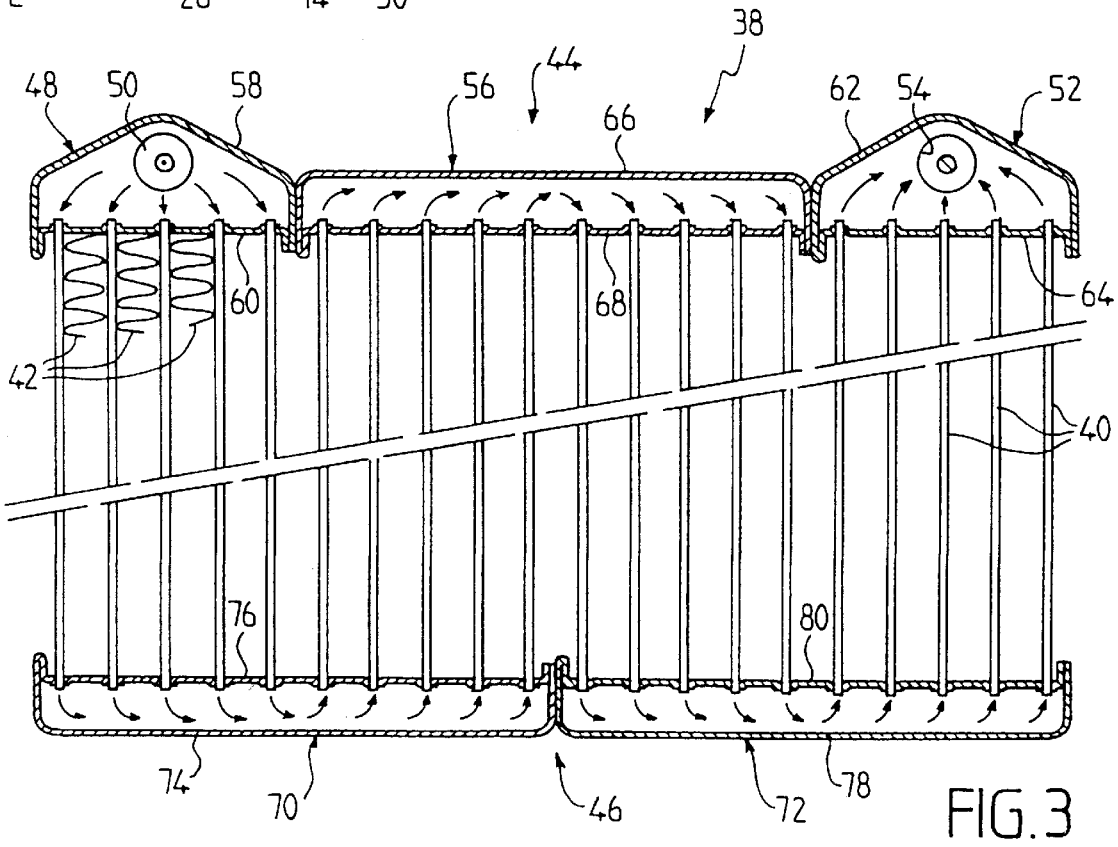
FIG. 3 is an overall sectional view of a heat exchanger comprising a bundle whose two ends are respectively connected to two fluid box/manifold assemblies according to the invention, one of the assemblies being formed by three housings and the other by two housings.

The heat exchanger 38 represented in FIG. 3 comprises a bundle of parallel tubes 40 (here flat tubes) which are separated by fins 42 of corrugated shape.

A first fluid box and manifold assembly 44 according to the invention and a second manifold and fluid box assembly 46 according to the invention are respectively provided at the two ends of the bundle.

The assembly 14 includes a first housing 48 provided with a fluid intake orifice 50, a second housing 52 provided with a fluid discharge orifice 54 and, between the two, a housing 56 for reversing the flow direction of the fluid in the exchanger.

In order to allow better standardisation, the housings 48 and 52 are similar. The housing 48 comprises a cap 58 having a double-slope base, produced integrally with a cover 60. Likewise, the housing 52 comprises a cap 62 with a double-slope base produced integrally with a cover 64. The central housing 56 comprises a cap 66 with a flat base produced integrally with a cover 68. The housings 48, 52 and 56 are juxtaposed, so that their respective covers 60, 64 and 68 are coplanar and jointly constitute a manifold linked to one of the ends of the bundle.

The assembly 46 comprises two fluid-reversal housings 70 and 72, produced in a similar way. The housing 70 comprises a cap 74 with a flat base produced integrally with a cover 76. Likewise, the housing 72 comprises a cap 78 with a flat base produced integrally with a cover 80.

The caps 66, 74 and 78 are closed with the exception of their open face and allow a reversal of the fluid direction.

The housings 70 and 72 are juxtaposed, so that their respective covers 76 and 80 are coplanar in order jointly to form another manifold linked to another end of the bundle.

The housings 48, 52, 56, 70 and 72 are produced in an analogous way to the housing in FIGS. 1 and 2.

Once the housings have been assembled with the tubes 40 of the bundle and with the fins 42, the entire assembly can be brazed in a single operation in a suitable brazing furnace.

This makes it possible to produce a motor-vehicle heat exchanger in which the fluid enters into the housing 48, subsequently flows in the bundle as indicated by the arrows, and leaves the exchanger through the housing 52.

The invention is not limited to the embodiments described above by way of example, and is susceptible of numerous variants relating to the shapes and the dimensions of the fluid box/manifold assemblies.

What is claimed is:

1. A fluid box/manifold assembly for a heat exchanger, intended to be connected to one end of a bundle of parallel tubes, comprising at least one housing produced in a single piece by stamping a sheet of metal and including:

a cap including a base which is linked to a peripheral wall delimiting an open face, and a cover including a base which is provided with holes suitable for accommodating ends of tubes and is linked to a peripheral edge having a shape matching that of the peripheral wall of the cap, the cap and the cover being linked by a strip of material constituting a fold line, so that the cap and the cover can be mutually brought together into an interlocking position in which the peripheral wall and the peripheral edge are interlocked in order to delimit an internal volume of the fluid box.

2. An assembly according to claim 1, wherein the peripheral wall of the cap and the peripheral edge of the cover are of quadrilateral overall shape, and wherein the strip of material links two equivalent sides of the cap and of the cover.

3. An assembly according to claim 2, wherein the two equivalent sides of the cap and of the cover are longitudinal sides.

4. An assembly according to claim 2, wherein the two equivalent sides of the cap and of the cover are transverse sides.

5. An assembly according to claim 1, wherein in the interlocking position, the peripheral edge of the cover is surrounded by the peripheral wall of the cap.

6. An assembly according to claim 1, wherein in the interlocking position, the peripheral edge of the cover and the peripheral wall of the cap are secured by joint brazing.

7. An assembly according to claim 1, wherein it is formed by aluminum-based sheet.

8. An assembly according to claim 1, wherein the cap is provided with at least one orifice for intake or discharge of fluid.

9. An assembly according to claim 1, wherein the cap is closed, with the exception of its open face, so as to allow a reversal of the fluid direction.

10. A heat exchanger comprising a bundle of parallel tubes which are joined, at least at one of their ends, by a manifold capped by a fluid box closing the manifold in a leaktight fashion and defining with it at least one internal volume imposing predetermined flow directions of the fluid in the tubes of the bundle, wherein the manifold and the fluid box comprise a manifold/fluid box assembly according to claim 1.

11. A method for producing a heat exchanger according to claim 10, in which a single-piece housing including:

a cap including a base which is linked to a peripheral wall delimiting an open face, and a cover including a base provided with holes suitable for accommodating ends of tubes and is linked to a peripheral edge having a shape matching that of the peripheral wall of the cap, is provided by stamping a sheet of metal, one side of said peripheral wall and one side of said peripheral edge being arranged substantially in the same plane and being linked to each other by a strip of material, and the cover is tilted relative to the cap about a fold line defined by the said strip of material so as to interlock the peripheral edge and the peripheral wall in one another.

* * * * *